US010427865B2

(12) United States Patent
Eggen

(10) Patent No.: US 10,427,865 B2
(45) Date of Patent: Oct. 1, 2019

(54) RESEALABLE INNER PACKAGE FOR A CONTAINER

(71) Applicant: PHILP MORRIS PRODUCTS S.A., Neuchatel (CH)

(72) Inventor: Adrian Eggen, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/778,426

(22) PCT Filed: Nov. 11, 2016

(86) PCT No.: PCT/IB2016/056810
§ 371 (c)(1),
(2) Date: May 23, 2018

(87) PCT Pub. No.: WO2017/098351
PCT Pub. Date: Jun. 15, 2017

(65) Prior Publication Data

US 2018/0339846 A1 Nov. 29, 2018

(30) Foreign Application Priority Data

Dec. 9, 2015 (EP) ..... 15198753

(51) Int. Cl.
*B65D 85/10* (2006.01)
*B65D 75/58* (2006.01)

(52) U.S. Cl.
CPC ..... *B65D 85/1045* (2013.01); *B65D 75/5838* (2013.01); *B65D 85/1027* (2013.01); *B65D 2575/586* (2013.01)

(58) Field of Classification Search
CPC ..... B65D 85/1045; B65D 75/5868; B65D 85/1027; B65D 2575/586
(Continued)

(56) References Cited

U.S. PATENT DOCUMENTS 3,327,887 A * 6/1967 Chalmers ..... B65D 85/10 206/268
6,505,735 B1 * 1/2003 Parker ..... B65D 75/5838 206/268
(Continued)

FOREIGN PATENT DOCUMENTS

CN 104724398 A 6/2015
EP 2 366 637 A1 9/2011
(Continued)

OTHER PUBLICATIONS

International Search Report and Written Opinion for PCT/IB2016/056810, issued by the European Patent Office as the International Preliminary Examining Authority, dated Jan. 5, 2017, 12 pgs.
(Continued)

*Primary Examiner* — Chun Hoi Cheung
(74) *Attorney, Agent, or Firm* — Mueting, Raasch & Gebhardt, P.A.

(57) ABSTRACT

A container includes a housing that has a box and a lid, where the box includes a front wall and a back wall. A hinged connector is connected to the lid at a first hinge line and connected to the back wall of the box at a second hinge line. The container also includes an inner package disposed within the housing. The inner package includes a first layer that defines a flap and a second layer at least partially attached to an inner surface of the first layer, where the second layer defines an access opening through which the consumer goods can be removed. The lid is movable between a closed position and an open position. The inner package is covered by the lid and the box when the lid is in the closed position and at least partially uncovered when the lid is in the open positon.

20 Claims, 5 Drawing Sheets

(58) Field of Classification Search
USPC ..... 206/242, 245, 251, 256, 261, 264, 273, 206/274
See application file for complete search history.

(56) References Cited

U.S. PATENT DOCUMENTS

| | | | | |
|---|---|---|---|---|
| 8,091,703 | B2 * | 1/2012 | Marchetti | B65D 5/606 206/268 |
| 8,474,612 | B2 * | 7/2013 | Bertuzzi | B65D 75/5838 206/264 |
| 9,089,165 | B2 * | 7/2015 | Bertuzzi | B65D 75/5894 |
| 9,499,331 | B2 * | 11/2016 | Seyfferth De Oliveira | B65D 85/1045 |
| 9,815,613 | B2 * | 11/2017 | Seyfferth De Oliveira | B65D 85/1045 |
| 10,077,151 | B2 * | 9/2018 | Bellamah | B31B 50/00 |
| 10,099,845 | B2 * | 10/2018 | Knudsen | B65D 85/1045 |
| 2011/0114518 | A1 * | 5/2011 | Hein | B65B 19/20 206/268 |
| 2015/0034509 | A1 * | 2/2015 | Seyfferth De Oliveira | B65D 85/1045 206/268 |
| 2015/0041346 | A1 * | 2/2015 | Seyfferth De Oliveira | B65D 85/1045 206/268 |
| 2015/0320111 | A1 * | 11/2015 | Slooff | B65D 85/1045 206/242 |
| 2015/0375923 | A1 * | 12/2015 | Pilzecker | B65D 85/1018 206/245 |
| 2016/0236855 | A1 * | 8/2016 | Chatelain | B65C 3/08 |
| 2016/0368645 | A1 * | 12/2016 | Buse | B65B 61/184 |

FOREIGN PATENT DOCUMENTS

| | | | |
|---|---|---|---|
| EP | 2 860 123 | A1 | 4/2015 |
| WO | WO 2008/142540 | A1 | 11/2008 |
| WO | WO 2012/147073 | A1 | 11/2012 |
| WO | WO 2013/120913 | A1 | 8/2013 |

OTHER PUBLICATIONS

International Preliminary Report on Patentability for PCT/IB2016/056810, issued by the European Patent Office as the International Preliminary Examining Authority, dated Oct. 30, 2017, 16 pgs.
Chinese Office Action for CN Application No. 201680065963.7, issued by the Chinese Patent Office dated Apr. 22, 2019, including English translation; 13 pgs.

* cited by examiner

RESEALABLE INNER PACKAGE FOR A CONTAINER

This application is the § 371 U.S. National Stage of International Application No. PCT/IB2016/056810, filed 11 Nov. 2016, which claims the benefit of EP patent application No. 15198753.4,filed 9 Dec. 2015, the disclosures of which are incorporated by reference herein in their entireties.

The present invention relates to a container for consumer goods with a resealable inner package. The container finds particular application as a container for elongate smoking articles such as cigarettes.

Smoking articles such as cigarettes and cigars are commonly packaged in rigid hinge-lid containers having a box and a lid connected to the box about a hinge line extending across the back wall of the container. Such hinge-lid containers are typically constructed from one-piece laminar cardboard blanks. In use, the lid is pivoted about the hinge line to open the container and so gain access from a front or top of the box to a bundle of smoking articles disposed within the box.

The bundle of smoking articles disposed within the box is typically wrapped in an inner liner of metalized paper, metal foil, or other flexible sheet material. To access the bundle of smoking articles within the inner liner, a consumer typically removes and discards a pre-perforated upper portion of the inner liner upon first opening the hinge-lid container.

However, to provide improved protection against the ingress and egress of, for example, air, moisture, flavors and odors, it is also known to enclose the bundle of smoking articles in a resealable, substantially airtight wrapper.

For example, International Patent Application WO-A-2008/142540 discloses a hinge-lid pack of smoking articles in which the smoking articles are enclosed in an inner package with an extraction opening closed by a cover flap that is fixed to the inner package using non-dry re-stick adhesive applied to the underside of the cover flap. The inner or outer surface of a bottom tab of the cover layer is glued permanently and non-removably to an inner surface of the lid of the hinge-lid pack so that opening and closing the lid simultaneously also opens and closes the cover flap.

One object of the invention is to produce a container for consumer goods that includes an extended access opening disposed in an inner package of the container that allows for more convenient access to the consumer goods.

In one aspect of the present invention, a container for consumer goods is described. The container includes a housing having a box and a lid, where the box includes a front wall and a back wall. The container also includes a hinged connector that connects the lid to the back wall of the box, where the hinged connector is connected to the lid at a first hinge line and connected to the back wall of the box at a second hinge line. Further, the container includes an inner package disposed within the housing that at least partially defines an interior volume for housing consumer goods. The inner package includes a front wall, a back wall, and a top wall. The inner package also includes a first layer that defines a flap, and a second layer that is at least partially attached to an inner surface of the first layer and that defines an access opening through which the consumer goods can be removed. Preferably, the access opening is disposed in a portion of the back and top walls of the inner package. The lid is movable between a closed position and an open position, where the inner package is covered by the lid and the box when the lid is in the closed position, and at least partially uncovered when the lid is in the open position. Further, the flap is attached to an inner surface of the lid such that the flap is separated from the inner package to at least partially uncover the access opening when the lid is moved from the closed position to the open position, and where the flap covers the access opening when the lid is in the closed position.

In current constructions, access to consumer goods disposed within a hinge-lid container can be challenging as an extraction or access opening of a sealed inner package disposed within the container may remain partially covered by a cover flap of the inner package even when the lid of the pack is open, thereby at least partially blocking access to the consumer goods. Further, accessing the consumer goods through the extraction opening can also be challenging because such opening is typically disposed in only one or both of a front wall and top wall of the inner package and not a back wall of the package. Grasping one of the consumer goods that can be tightly packaged within the inner package (for example, when removing a first consumer good from a newly opened container) can be challenging as the user can only grasp the consumer good from one or both of front and top sides of the container and not from a back side of the container.

Various aspects of the present invention may have one or more advantages relative to currently-available or previously-described containers. For example, an access opening disposed in an inner package of the container can be extended to provide access to consumer goods from one or more of the front, top, and back walls of the inner package, thereby allowing a consumer to grasp consumer goods from the front, top, and back sides of the container.

The present invention is applicable to any suitable container for consumer goods that includes an inner package. Accordingly, in one or more embodiments, the container further includes the consumer goods, wherein the consumer goods are housed in the interior volume defined by the inner package. Preferably, the consumer goods are smoking articles. It is known to package consumer goods such as, for example, elongate smoking articles in containers formed from folded laminar blanks. For example, elongate smoking articles, such as cigarettes and cigars, are commonly sold in hinge-lid packs having a box for housing the smoking articles and a lid connected to the box. The box may include a front wall, a left side wall, a right side wall, a back wall, and a bottom wall. The lid may include a front wall, a left side wall, a right side wall, a back wall, and a top wall.

The consumer goods within the container may be wrapped in an inner liner. The inner liner and consumer goods together form an inner package. The container can also include one or more inner frames disposed in any suitable location within the container. An inner frame can be disposed between the inner package and the front wall of the box or within the inner package. In one or more embodiments, a first inner frame can be disposed between the inner package and the front wall of the box and a second inner frame can be disposed within the inner package. Prior to first opening, the filled container may be wrapped in an outer wrapper.

The container may take any suitable form for housing consumer goods. For example, as already mentioned, the container may be a hinge-lid container having one or more hinged lids connected to a box housing the consumer goods. In one or more embodiments, the container may be a slide and shell container having an inner slide for housing the consumer goods mounted within an outer shell. Where the container is a slide and shell container, the outer shell or the inner slide may include one or more hinge lids. The container, inner frame, inner package, and outer wrapper may be formed from any suitable materials including, but not limited to, cardboard, paperboard, plastic, metal, or combinations thereof. The cardboard may have a weight of between about 100 grams per square meter and about 350 grams per square meter.

Containers according to the invention may be in the shape of a rectangular parallelepiped, with right-angled longitudinal and right-angled transverse edges. Alternatively, the container may include one or more rounded longitudinal edges, rounded transverse edges, bevelled longitudinal edges, or bevelled transverse edges, or combinations thereof. For example, the container according to the invention may include, without limitation, one or more of the following features:

- one or two longitudinal rounded or bevelled edges on at least one of the front wall and the back wall;
- one or two transverse rounded or bevelled edges on at least one of the front wall and the back wall;
- one longitudinal rounded edge and one longitudinal bevelled edge on the front wall, or one transverse rounded edge and one transverse bevelled edge on the back wall;
- one longitudinal rounded edge and one longitudinal bevelled edge on the front wall, and one transverse rounded edge and one transverse bevelled edge on the back wall;
- one or two transverse rounded or bevelled edges on the front wall and one or two longitudinal rounded or bevelled edges on the front wall; and
- two longitudinal rounded or bevelled edges on a first side wall or two transverse rounded or bevelled edges on the second side wall.

Where the container includes one or more rounded edges, preferably the blanks forming the container include three, four, five, six, or seven scoring lines or creasing lines to form each rounded edge in the assembled container. The scoring lines or creasing lines may be either on the inside of the container or on the outside of the container. Preferably, the scoring lines or creasing lines are spaced from each other by between about 0.3 mm and 4 mm.

Preferably, the spacing of the creasing lines or scoring lines is a function of the thickness of the laminar blank. Preferably, the spacing between the creasing lines or scoring lines is between about 0.5 and about 4 times larger than the thickness of the laminar blank.

Where the container includes one or more bevelled edges, preferably the bevelled edge has a width of between about 1 mm and about 10 mm, preferably between about 2 mm and about 6 mm. In one or more embodiments, the container may include a double bevel formed by three parallel creasing or scoring lines that are spaced such that two distinct bevels are formed on the edge of the container. Where the container includes a bevelled edge, the bevel may be formed by two parallel creasing lines or scoring lines in the laminar blank from which the container is formed. The creasing lines or scoring lines may be arranged symmetrically to the edge between a first wall and a second wall. Alternatively, the creasing lines or scoring lines may be arranged asymmetrically to the edge between the first wall and the second wall, such that the bevel reaches further into the first wall of the container than into the second wall of the container.

Alternatively, the container may have a non-rectangular transverse cross section, for example, polygonal such as triangular or hexagonal, or oval, semi-oval, circular or semi-circular.

Containers according to the invention find particular application as packs for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes.

Through an appropriate choice of the dimensions thereof, containers according to the invention may be designed to hold different total numbers of smoking articles, or different arrangements of smoking articles. For example, through an appropriate choice of the dimensions thereof, containers according to the invention may be designed to hold a total of between ten and thirty smoking articles.

As well as housing a bundle of smoking articles, the container may further include other consumer goods, for example, matches, lighters, extinguishing means, breath fresheners, or electronics. Other consumer goods may be attached to the outside of the container, contained within the container along with the smoking articles, in a separate compartment of the container, or combinations thereof.

A hinged connector can connect the lid of the container to the box. The hinged connector can connect the lid to any suitable portion of the box. In one or more embodiments, the hinged connector can connect the lid to the back wall of the box. In one or more embodiments, the hinged connector can be a separate element that is attached to the lid and the back wall the box. In such embodiments, the hinged connector can include any suitable material or combination of materials, for example, the same material as that of the box. Preferably, the hinged connector is integral with at least one of the lid and the back wall of the box. More preferably, the hinged connector is integral with both the lid and the back wall of the box.

In one or more embodiments, the hinged connector can be connected to the lid at a first hinge and connected to the back wall of the box at a second hinge. The first and second hinges can include any suitable type of hinge. In one or more embodiments, the hinged connector can be integral with one or both of the lid and the back wall of the box. In such embodiments, the first hinge can include a first hinge line and the second hinge can include a second hinge line. The term "hinge line" refers to a line about which the lid and the hinged connector may be pivoted. Although described herein as including first and second hinge lines, each of the first and second hinges can include any suitable hinge that is manufactured and then attached to the hinged connector, the lid, and the back wall of the box. In one or more embodiments, the lid can pivot about the first hinge line as the lid is being moved between an open position and a closed position. Further, in one or more embodiments, the hinged connector can pivot about the second hinge line as the lid is moved between the closed position and the open position. In one or more embodiments, the lid can pivot about the first hinge line and the hinged connector can pivot about the second hinge line as the lid is moved between the closed position and the open position.

The first and second hinge lines can be formed using any suitable technique or combination of techniques. For example, one or both of the first and second hinge lines may be a fold line or a score line disposed in the panel that forms the back wall of the box. Each of the first and second hinge lines can take any suitable shape or combination of shapes. In one or more embodiments, one or both of the first and second hinge lines can be a straight line that extends in a transverse direction relative to a longitudinal axis of the container.

The hinged connector can take any suitable shape or combination of shapes. In one or more embodiments, the hinged connector can take a rectangular shape. Further, the hinged connector can have any suitable dimensions. The hinged connector includes an average transverse width as measured in a direction transverse to the longitudinal axis of the container. In one or more embodiments, the average transverse width of the hinged connector is the same as an average transverse width of the back wall of the box. Preferably, the hinged connector includes an average transverse width that is between about 40% and about 90% of an average transverse width of the back wall the box. More preferably, the hinged connector includes an average transverse width that is between about 60% and about 80% of an average transverse width of the back wall of the box. Further, the hinged connector can have any suitable average longitudinal length extending between the first and second hinge lines as measured in a direction parallel to the longitudinal axis of the container. Preferably, the hinged connector has an average longitudinal length of between about 3 mm and about 30 mm. More preferably, the hinged connector has an average longitudinal length that is between about 4 mm and about 10 mm. Even more preferably, the hinged connector has an average longitudinal length that is between about 5 mm and about 15 mm.

The hinged connector can include a first longitudinal edge and a second longitudinal edge. In one or more embodiments, one or both of the first and second longitudinal edges extends in a longitudinal direction between the first hinge line and the second hinge line. The first and second longitudinal edges can be disposed in any suitable position on or in the back wall of the box. In one or more embodiments, the first longitudinal edge and the second longitudinal edge can be disposed along first and second longitudinal edges of the back wall of the box respectively. In one or more embodiments, the first longitudinal edge of the hinged connector can be disposed at a first distance from the first longitudinal edge of the back wall, and the second longitudinal edge of the hinged connector can be disposed at a second distance from the second longitudinal edge of the back wall. In one or more embodiments, the first distance and the second distance are equal. In such embodiments, the hinged connector can be symmetrical about the longitudinal axis of the container. Further, in one or more embodiments, the first distance can be greater than or less than the second distance.

In embodiments where the hinged connector is integral with the back wall of the box, the first and second longitudinal edges of the hinged connector can be formed using any suitable technique or combination of techniques, for example, laser cutting or mechanical cutting (for example, die cutting or kiss cutting). In such embodiments, the hinged connector can be separated along the first and second longitudinal edges such that the lid can be moved between the closed position and the open position.

In embodiments where the hinged connector is integral with the back wall of the box, the first and second longitudinal edges of the hinged connector can include any suitable depth in a direction transverse to the back wall of the box prior to the hinged connector being separated from the back wall. Preferably, one or both of the first and second longitudinal edges can have a depth that is at least about 90 percent of a total thickness of the back wall of the box. More preferably, one or both of the first and second longitudinal edges can have a depth that is about 100 percent of the total thickness of the first layer. Any suitable percentage of material can remain along the first and second longitudinal edges of the hinged connector after the edges have been formed. Preferably, between about 5 percent and about 25 percent of material of the back wall of the box remains along the first and second longitudinal edges after the edges have been formed.

In one or more embodiments where the hinged connector is integral with at least the back wall of the box, one or more lines of weakness may be disposed in the back wall of the box that facilitates separating the hinged connector from the back wall. In one or more embodiments, a first line of weakness can be disposed in the back wall in a transverse direction between the first longitudinal edge of the back wall and the first longitudinal edge of the hinged connector. The first line of weakness can extend along a first hinge line axis that is collinear with the first hinge line. Further, the first line of weakness can intersect the first longitudinal edge of the hinged connector. In or more embodiments, a second line of weakness can be disposed in the back wall in a transverse direction between the second longitudinal edge of the back wall and the second longitudinal edge of the hinged connector. The second line of weakness can extend along the first hinge line axis. Further, the second line of weakness can intersect the second longitudinal edge of the hinged connector. In one or more embodiments, the first and second lines of weakness disposed in the back wall can facilitate separating the lid and the hinged connector from the back wall of the box such that the lid can be moved between the closed position and the open position.

The first and second hinge lines that connect the hinged connector to the lid and the back wall of the box can be disposed in any suitable location relative to the lid and the box. In one or more embodiments, the first hinge line can be disposed at an average longitudinal distance of between about 0 mm and about 15 mm from a top edge of the back wall of the box as measured along the longitudinal axis of the container. In one or more embodiments, the first hinge line can be disposed at an average longitudinal distance of between about 2 mm and about 15 mm from the top edge of the back wall. In one or more embodiments, the first hinge line can be disposed at an average longitudinal distance of between about 3 mm and about 12 mm from the top edge of the box. Further, in one or more embodiments, the first hinge line can be disposed at an average longitudinal distance of between about 4 mm and about 8 mm from the top edge of the back wall of the box.

In one or more embodiments, the lid can be rotated about the first hinge line such that the lid can be moved between the closed position and the open position. Further, in one or more embodiments, the hinged connector can be rotated about the second hinge line such that the lid can be moved between the closed position and the open position. In one or more embodiments, the lid can be rotated about the first hinge line and the hinged connector can be rotated about the second hinge line such that the lid is moved between the closed position and the open position.

The lid is movable between the closed position and the open position. When the lid is in the closed position, the inner package is covered by the lid and the box. Further, when the lid is in the open position, the inner package is at least partially uncovered. In one or more embodiments, a top portion of the inner package that extends beyond the box of the container is completely uncovered when the lid is in the open position.

Disposed within the housing is an inner package that includes the consumer goods. The inner package at least partially defines an interior volume for housing consumer goods. Preferably, the inner package is formed from a material that includes a first layer and a second layer attached to the first layer. The inner package can include a top wall, bottom wall, front wall, back wall, and side walls.

The first layer can include an inner surface and an outer surface. The first layer defines a flap of the inner package. In one or more embodiments, the first layer can be an adhesive label that is attached to the second layer. Further, in one or more embodiments, the first layer can also include a first line of weakness formed in the first layer that defines a flap of the inner package. The first line of weakness can take any suitable shape or combination of shapes. Preferably, the first line of weakness defines a flap that has three sides that separate the flap from the first layer, and a fourth side that forms a hinge line between the flap and the first layer. In one or more embodiments, the flap can be attached to an inner surface of the lid of the box such that upon opening the lid the flap is separated from the inner package along the first line of weakness. In such embodiments, the flap can take any suitable shape when the lid is in the open position, for example, an S-shape. The flap can take any suitable shape or combination of shapes and have any suitable dimensions. Further, the flap can take any suitable shape or combination of shapes and have any suitable dimensions.

The first line of weakness can be continuous or discontinuous (for example, perforated). Further, the first line of weakness can be formed using any suitable technique or combination of techniques, for example, laser cutting or mechanical cutting (for example, die cutting or kiss cutting). The first line of weakness can include any suitable depth in a direction transverse to the inner and outer surfaces of the first layer. Preferably, the first line of weakness has a depth that is at least about 90 percent of a total thickness of the first layer. More preferably, the first line of weakness has a depth that is about 100 percent of the total thickness of the first layer. Any suitable percentage of material can remain along the first line of weakness after the line has been formed. Preferably, between about 5 percent and about 25 percent of material of the first layer remains along the first line of weakness after the line has been formed.

The second layer can include an inner surface and an outer surface. The second layer can define an access opening through which consumer goods can be removed. The access opening can be disposed in any suitable location on the inner package. In one or more embodiments, the access opening is disposed in a portion of the front wall of the inner package. In one or more embodiments, the access opening is disposed in a portion of a top wall of the inner package. In one or more embodiments, the access opening is disposed in a portion of the back wall of the inner package. In one or more embodiments, the access opening is disposed in a portion of one or more of the front, top, and back walls of the inner package. Preferably, the access opening is disposed in a portion of the top and back walls. Further, in one or more embodiments, the access opening is disposed in a portion of each of the front, top, and back walls of the inner package.

In one or more embodiments, the second layer can include a second line of weakness formed in the second layer that defines the access opening. The access opening is covered by the flap defined by the first layer when the flap is in the closed position. In one or more embodiments where the flap is attached to an inner surface of the lid, the access opening is covered by the flap when the lid is in the closed position. Further, the access opening is at least partially uncovered when the flap of the first layer and the lid are in the open position. In one or more embodiments, the access opening is completely uncovered when the flap and the lid are in the open position. When the flap and the lid are in the open position, a portion of the second layer attached to the flap is separated from the inner package along the second line of weakness to reveal the access opening.

The second line of weakness can take any suitable shape or combination of shapes to define the access opening. The second line of weakness can be continuous or discontinuous (for example, perforated). Further, the second line of weakness can be formed using any suitable technique or combination of techniques, for example, laser cutting or mechanical cutting (for example, die cutting or kiss cutting). The second line of weakness can include any suitable depth in a direction transverse to the inner and outer surfaces of the second layer. Preferably, the second line of weakness has a depth that is about 90 percent of a total thickness of the second layer. More preferably, the second line of weakness has a depth that is about 100 percent of the total thickness of the second layer. Any suitable percentage of material can remain along the second line of weakness after the line has been formed. Preferably, between about 5 percent and about 25 percent of material of the second layer remains along the second line of weakness after the line has been formed.

The inner package may be more securely sealed along the first and second lines of weakness before the first opening of the container. This may increase the storage life of the consumer goods contained within the container.

The second layer can be attached to the inner surface of the first layer using any suitable technique or combination of techniques. Preferably, the second layer is attached to the inner surface of the first layer using an adhesive. Any suitable adhesive or combination of adhesives can be utilized. Preferably, the adhesive is a releasable adhesive. Any suitable releasable adhesive can be utilized, for example, a pressure sensitive adhesive.

The first and second layers can include any suitable material or combination of materials. The first layer can include the same materials as the second layer or different materials from the second layer. Preferably, at least one of the first and second layers is formed of metal foil or metalized paper. At least one of the first and second layers may be formed as a laminate of a metalized polyethylene film and a liner material. At least one of the first and second layers can have a thickness that is between about 10 microns and about 50 microns. In addition, the first and second layers may be provided with a print-receptive top coating.

Any suitable technique or combination of techniques can be utilized to form the first layer and the second layer. In one or more embodiments, at least one of the first layer and the second layer can be extruded. In one or more embodiments, the first and second layers can be coextruded. In one or more embodiments, one or both of the first and second layers can be oriented in one or both of a longitudinal direction and a transverse direction. In one or more embodiments, at least one of the first layer and the second layer can be cast and cured.

The second layer can have any suitable dimensions in relation to the first layer. In one or more embodiments, the second layer is coextensive with the first layer, in other words, the second layer extends to an outer perimeter of the first layer. In one or more embodiments, the second layer can have a surface area that is less than a surface area of the first layer. For example, the second layer can be an adhesive label attached to the first layer, where the second layer is not coextensive with the first layer. Further, for example the first layer can be an adhesive label attached to the second layer, where the first layer is not coextensive with the second layer.

At least a portion of the outer surface of the first layer can be permanently affixed to a corresponding portion of an inner surface of the back wall of the box. Any suitable technique or combination of techniques can be utilized to affix this portion of the outer surface of the first layer to the back wall of the box. Preferably, a permanent adhesive is utilized to attach the portion of the outer surface of the first layer to the back wall of the box. Further, at least a portion of the outer surface of the first layer can be permanently affixed to a corresponding portion of an inner surface of the front wall of the box. Once again, any suitable technique or combination of techniques can be utilized to attach this portion of the outer surface of the first layer to the inner surface of the front wall of the box, for example, adhering the outer surface of the first layer to the inner surface of the front wall of the box with a permanent adhesive.

The flap of the inner package defined by the first layer can be attached to an inner surface of the lid of the housing. Any suitable technique or combination of techniques can be utilized to attach the flap to the inner surface of the lid, for example, mechanical fasteners, adhesives, thermal or ultrasonic bonds, and combinations thereof. Preferably, the flap is attached to the inner surface of the lid using an adhesive. The adhesive can be any suitable adhesive or combination of adhesives. Preferably, the adhesive is a permanent adhesive. Any suitable portion of the flap can be attached to the inner surface of the lid. In one or more embodiments, a portion of the outer surface of the first layer that defines the flap is attached to the inner surface of the lid. In one or more embodiments, a portion of the inner surface of the first layer that defines the flap is attached to the lid.

The flap is adapted to reattach to the second layer when the flap is in the closed position. The same adhesive used to attach the second layer to the first layer can be disposed between the flap and the second layer to reattach the flap to the second layer when the flap is in the closed position. In one or more embodiments, an alternative or additional adhesive or adhesives can be disposed along at least a portion of the second layer along a periphery of the access opening formed in the second layer such that the flap can be attached to the second layer when in the closed position. This portion of the second layer along the periphery of the access opening defines a seal region of the second layer. At least a portion of the seal region overlaps with the flap when the flap is in the closed position. The adhesive disposed between the flap and the second layer allows for repeated opening and closing of the flap such that the consumer goods disposed within the inner package can be accessed when the flap is in the open position, and so that the consumer goods remain sealed within the inner package when the flap is in the closed condition. Preferably, the adhesive disposed between the flap and the second layer provides sufficient adhesion for the flap to be reattached at least as many times as there are consumer goods within the inner package such that the consumer can open and reseal the inner package until the package is empty.

Preferably, the flap can have an area that is greater than an area of the access opening defined by the second layer of the inner package so that the access opening is covered by the flap when the flap is in the closed position. In one or more embodiments, the first line of weakness that defines the flap exposes the seal region of the second layer. The seal region can have any suitable dimension or dimensions. For example, in one or more embodiments, the seal region can have a constant width that extends from a perimeter of the access opening to the first line of weakness. In one or more embodiments, the seal region can have a width that varies along the perimeter of the access opening. Preferably, the average width of the seal region is 2-5 mm. Preferably, a surface area of the seal region is between about 25 percent and about 300 percent of an area of the access opening. More preferably, the surface area of the seal region is between about 25 percent to about 65 percent of the area of the access opening.

The container can also include one or more inner frames disposed within the box. An inner frame can be disposed between the inner package and the front wall of the box or within the inner package. In one or more embodiments, a first inner frame can be disposed between the inner package and the front wall of the box and a second inner frame can be disposed within the inner package. When disposed within the inner package, the inner frame is positioned such that a front wall of the inner package is between the inner frame and the front wall of the box. The inner frame includes a front wall and a pair of opposed sidewalls. Preferably, the inner frame is U-shaped. The term "U-shaped" is used herein to refer to a shape that includes at least three parts, where the first part and the third part are parallel to each other and extend in the same direction perpendicular to the second part.

Preferably, the front wall of the inner frame is disposed such that the front wall of the inner package is between the front wall of the inner frame and the front wall of the box. Advantageously, an inner frame with a large surface area provided adjacent the front wall of the inner package increases the structural strength of the container. The increased structural strength provided by the inner frame allows the more secure closing of the flap. This is particularly advantageous for subsequent closing operations when the container is no longer full.

Preferably, the inner frame includes a cut-out at the top of the front wall. The cut-out preferably substantially corresponds to the access opening, and is provided such that the consumer goods within the inner package may be more easily accessed. Where the inner frame includes a cut-out, the height of the inner frame is defined as the distance from the bottom of the inner frame to the cut-out.

The inner frame may include one or more reinforcing elements. Preferably, the one or more reinforcing elements includes an adhesive, such that the adhesive reinforces the inner frame and inner package. Alternatively, the one or more reinforcing elements may include at least one layer of material, such as a similar cardboard to that utilized for manufacturing the inner frame, affixed to the inner frame. In this alternative, the at least one further layer of material is permanently affixed to the inner frame. Preferably, the at least one further layer is elongate. Where the inner frame is U-shaped, the at least one layer of material is preferably affixed to the outer surface of the front wall of the inner frame. Preferably, the at least one layer is affixed adjacent the top of the inner frame.

Preferably, the container can further include an adhesive label disposed over the flap defined by the first layer of the material that forms the inner package. The adhesive label can be attached to the first layer such that it covers the flap and can provide an additional seal so that both the flap and the label seal the access opening. In one or more embodiments, the adhesive label can be attached to the inner surface of the lid. In one or more embodiments, both the flap and the adhesive label can be attached to the inner surface of the lid.

In one or more embodiments, the inner package can include a decorative or informational adhesive label disposed on the outer surface of the first layer of the inner package or on one or more walls of the box or lid. The adhesive label can include any suitable material or materials and can have any suitable dimensions. Further, the adhesive label can be disposed in any suitable location on the outer surface of the first layer. In one or more embodiments, the adhesive label can include indicia disposed on an outer surface of the label, and the label can be disposed in a location on the outer surface of the first layer such that the label can be viewed by a consumer.

There is provided a carton comprising the container having any of the features described above. A carton that includes a lid and at least one sidewall can contain multiple containers as described herein.

The terms "front," "back," "upper," "lower," "side," "top," "bottom," and other terms used to describe relative positions of the components of containers or inner packages refer to the container or inner package in an upright position with the lid at the top end and the consumer goods accessible from the upper end. The terms "left" and "right" can be used with reference to side walls of the container or the inner package when the container and inner package are viewed from the front in its upright position.

The term "inner surface" is used herein to refer to the surface of a component of the assembled container that is facing towards the interior of the container, for example towards the consumer goods, when the container is in the closed position.

The term "longitudinal axis" is used herein to describe an axis of the container that extends between a top wall and a bottom wall of the container.

The term "outer surface" is used herein to refer to the surface of a component of the container that is facing towards the exterior of the container. For example, in one or more embodiments, the container includes an inner frame that includes an outer surface that is facing the outer housing of the container and an inner surface that is facing the inner package of the container.

All scientific and technical terms used herein have meanings commonly used in the art unless otherwise specified. The definitions provided herein are to facilitate understanding of certain terms used frequently herein.

Referring now to the drawings, in which some aspects of the present invention are illustrated:

Figure 1:
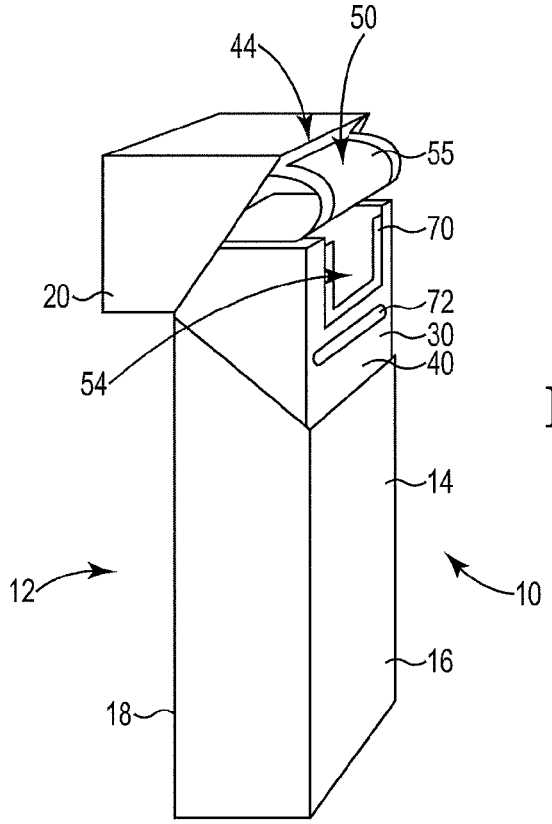
FIG. 1 is a schematic perspective view of a container with a lid of the container in an open position, where the container includes a housing and an inner package disposed within the housing.

Referring to FIG. 1, a schematic perspective view of an embodiment of a container 10 for consumer goods is depicted. The container includes a housing 12 that includes a box 14 and a lid 20. The box 14 includes a front wall 16 and a back wall 18. An inner package 30 is disposed within the housing 12. The inner package 30 at least partially defines an interior volume for housing consumer goods. In one or more embodiments, the inner package 30 is made from a barrier material or materials to hermetically seal the consumer goods before the container is opened for the first time. The barrier material may be a metal foil or a plastic and metal laminate.

Figure 2:
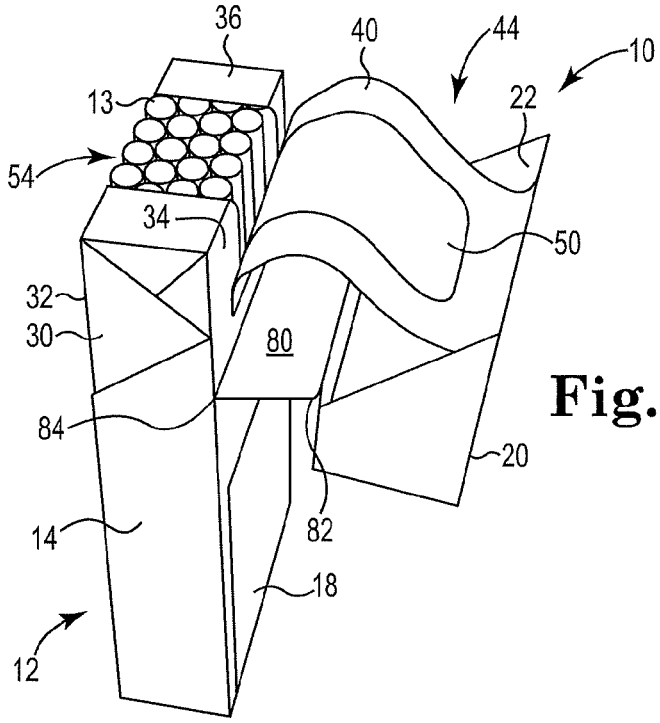
FIG. 2 is a schematic top perspective view of the container of FIG. 1.
Figure 3:
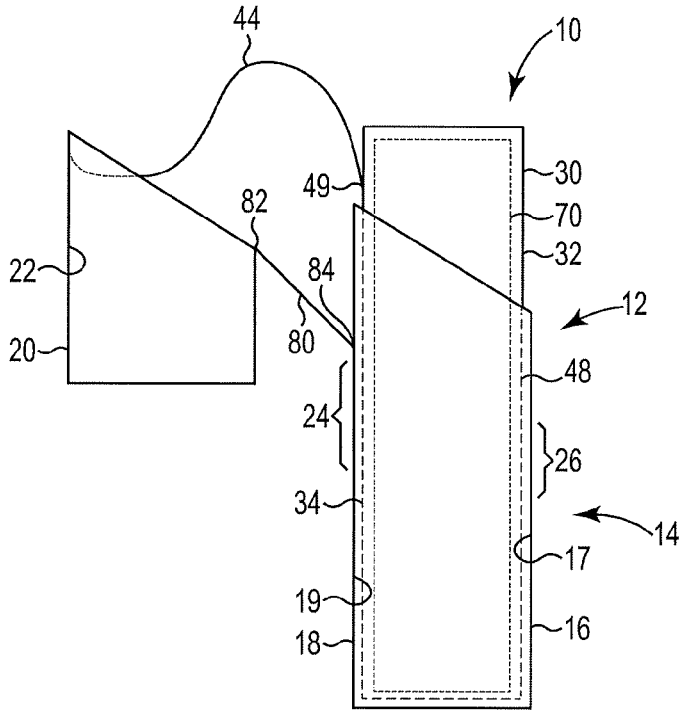
FIG. 3 is a schematic side cross-section view of the container of FIG. 1.
Figure 4:
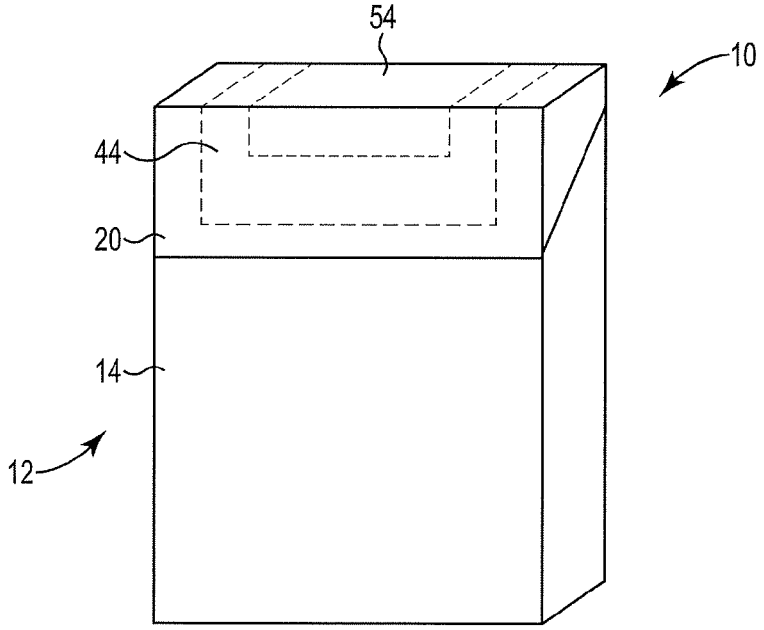
FIG. 4 is a schematic perspective view of the container of FIG. 1 with the lid in a closed position.

The inner package 30 includes a front wall 32 and a back wall 34 (FIG. 2). The inner package 30 also includes a first layer 40 and a second layer 50 attached to an inner surface 46 (FIG. 5) of the first layer 40. The first layer 40 includes a first line of weakness 42 (FIG. 5) that defines a flap 44. Further, the second layer 50 includes a second line of weakness 52 (FIG. 5) that defines an access opening 54 through which the consumer goods 13 (FIG. 2) can be removed. The consumer goods 13 have not been shown in FIG. 1 for clarity. The access opening 54 is covered by the flap 44 when the flap and the lid 20 are in the closed position (FIG. 4). Further, the access opening 54 is at least partially uncovered when the flap 44 and the lid 20 are in the open position (FIG. 1). The flap 44 is attached to the first layer 40 along a hinge line 49 (FIG. 3). The hinge line 49 is disposed in the back wall 34 of the inner package 30. The flap 44 is also attached to an inner surface 22 (FIG. 3) of the lid 20 such that upon opening the lid the flap and a portion 55 (FIG. 5) of the second layer 50 attached to the flap are separated from the inner package 30 along the first and second lines of weakness 42, 52 respectively to reveal the access opening 54.

The container 10 also includes an inner frame 70 disposed within the inner package 30. The inner frame 70 can include a reinforcing element 72 disposed between the inner frame and an inner surface 17 (FIG. 3) of the front wall 16 of the box 14.

Referring to FIG. 2, a schematic top perspective view of the container 10 of FIG. 1 is depicted with the lid 20 and the flap 44 in the open position. A hinged connector 80 connects the lid 20 to the back wall 18 of the box 14. The hinged connector 80 is connected to the lid 20 at a first hinge line 82 and connected to the back wall of the box 14 at a second hinge line 84. In the embodiment illustrated in FIGS. 1-6, the hinged connector 80 is integral with the lid 20 and the back wall 18 of the box 14. In one or more embodiments, the hinged connector 80 can be a separate element that is attached to the lid 20 and the box 14 using any suitable technique or combination of techniques.

The inner package 30 is disposed within the housing 12 and at least partially defines an interior volume for housing consumer goods 13. The inner package 30 includes the first layer 40 that defines the flap 44, and the second layer 50 that is at least partially attached to an inner surface of the first layer. The second layer 50 defines the access opening 54 through which the consumer goods 13 can be removed. The access opening 54 is disposed in a portion of the front wall 32, top wall 36, and back wall 34 of the inner package 30.

The lid 20 is movable between the closed position (FIG. 4) and the open position (FIGS. 1-3). The inner package 30 is covered by the lid 20 and the box 14 when the lid is in the closed position and at least partially uncovered when the lid is in the open position. As illustrated in FIG. 1, the lid 20 has been moved from the closed position to the open position by rotating the lid about the first hinge line 82. Although not shown in FIG. 1, the lid 20 can be moved to the open position by rotating the hinged connector 80 (not shown) about the second hinge line 84 (as shown in FIG. 2), and by rotating the lid about the first hinge line 82 and rotating the hinged connector about the second hinge line 84.

The flap 44 is attached to the inner surface 22 of the lid 20 such that the flap is separated from the inner package 30 to at least partially uncover the access opening 54 when the lid is moved from the closed position to the open position.

Further, the flap 44 covers the access opening 54 when the lid 20 is in the closed position.

Referring to FIG. 3, a schematic cross-section view of the container 10 of FIG. 1 is depicted with the lid 20 and the flap 44 in the open position. The inner package 30 is shown disposed within the box 14 of housing 12, and the inner frame 70 is disposed within the inner package. The flap 44 is attached to the inner surface 22 of the lid 20. In the open position, the flap 44 forms an S-shape. The geometry of the container 10 is such that the flap 44 is automatically resealed to the inner package 30 when the flap (and the lid 20) is returned to the closed position.

At least a portion of an outer surface 48 of the first layer 40 of the inner package 30 is permanently affixed to a corresponding portion of an inner surface 19 of the back wall 18 of the box 14, thereby affixing the inner package to the inner surface of the back wall of the box in a first region 24. Further, at least a portion of the outer surface 48 of the first layer 40 of the inner package 30 is permanently affixed to a corresponding portion of the inner surface 17 of the front wall 16 of the box 14, thereby affixing the inner package to the inner surface of the front wall of the box in a second region 26. By permanently affixing at least a portion of the inner package 30 to one or both of the front wall 16 and the back wall 18 of the box 14, the structural resilience of the inner package may be further improved. The inner package 30 may be permanently affixed using, for example, hot melt adhesive, solvent based adhesive, water based adhesive, solvent-free adhesive, pressure-sensitive adhesive, conductive type sealing, and inductive type sealing. In a preferred embodiment, the inner package 30 is permanently attached to the box 14 using a hot melt adhesive.

As illustrated in FIG. 3, the hinged connector 80 is connected to the lid 20 at the first hinge line 82. Further, the hinged connector 80 is connected to the back wall 18 of the box 14 at the second hinge line 84. The lid 20 can be moved between the closed position and the open position by rotating the lid about the first hinge line 82. In one or more embodiments, the lid 20 can be moved between the closed position and the open position by rotating the hinged connector 80 about the second hinge line 84. Further, in one or more embodiments, the lid 20 can be moved between the closed position and the open position by rotating the lid 20 about the first hinge line 82 and rotating the hinged connector 80 about the second hinge line 84.

Referring to FIG. 4, a schematic perspective view of the container 10 of FIG. 1 is depicted. The lid 20 of the container 10 and the flap 44 of the inner package 30 are in the closed position. The flap 44 is attached to the second layer 50 (FIG. 5) when the flap is in the closed position.

Figure 5:
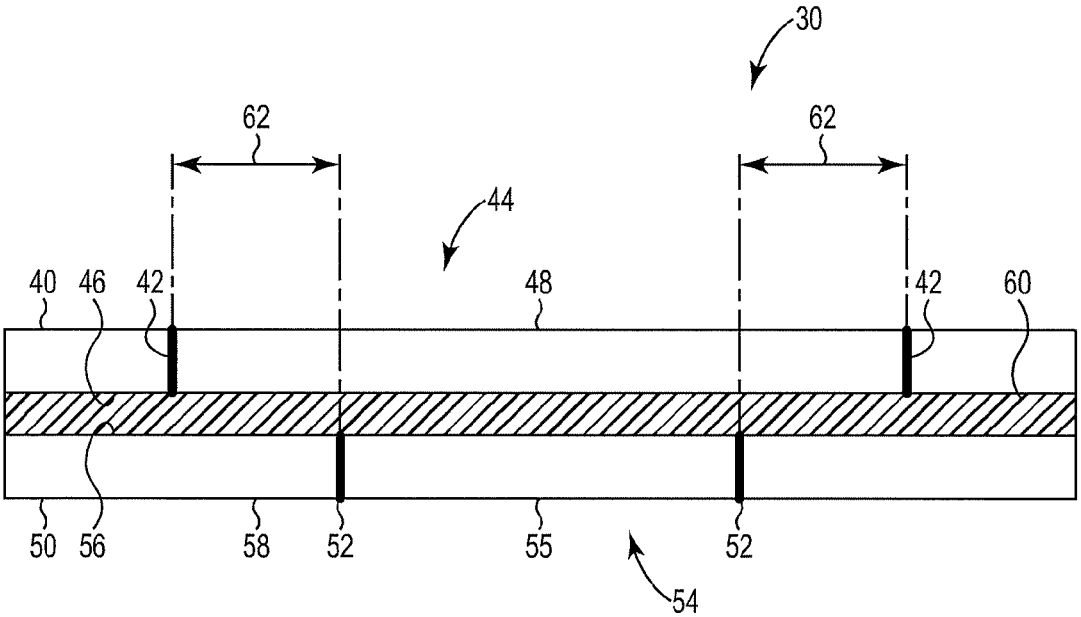
FIG. 5 is a schematic cross-section view of a portion of the inner package of FIG. 1.

Referring to FIG. 5, a schematic cross-section view of a portion of the inner package 30 of FIG. 1 is depicted. Although the material that forms the inner package 30 is depicted as including first and second layers 40, 50 that are coextensive, in one or more embodiments, the first layer 40 can include an adhesive label that is attached to the second layer 50, where the adhesive label defines the flap 44. The first layer 40 includes the first line of weakness 42 that defines the flap 44. The second layer 50 is attached to the inner surface 44 of the first layer 40 with adhesive 60. The second layer 50 includes the second line of weakness 52 that defines the access opening 54. As shown in FIG. 5, the access opening 54 is covered by the flap 44 when the flap is in the closed position. The flap 44 is adapted to be attached to the second layer 50 when the flap is in the closed position.

A seal region 62 is formed between the first line of weakness 42 and the second line of weakness 52. The flap 44 is adapted to overlap the access opening 54 into the seal region 62 such that the flap attaches to the second layer 50 within the seal region when the flap is in the closed position. In one or more embodiments, the seal region 62 has a constant width along a perimeter of the access opening 54. In one or more embodiments, the seal region 62 has a width that varies along a perimeter of the access opening 54.

The inner package 30 also includes the portion 55 of the second layer 50 that remains attached to the flap 44 when the flap is moved from the closed position to the open position. In other words, upon opening the lid 20 (FIGS. 1-3), the flap 44 and the portion 55 of the second layer 50 attached to the flap are separated from the inner package 30 along the first and second lines of weakness 42, 52 respectively to reveal the access opening 54.

Figure 6:
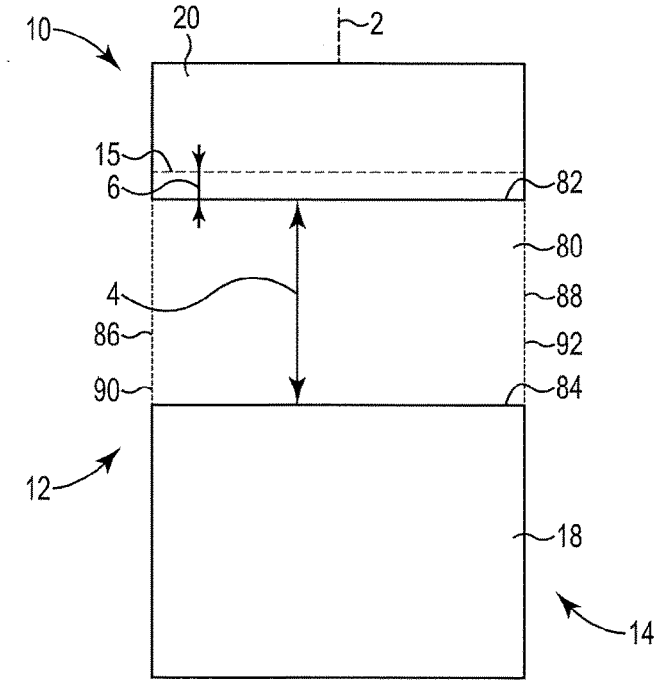
FIG. 6 is a schematic rear view of the back wall of the container of FIG. 1.

Referring to FIG. 6, a schematic plan view of the back wall 18 of the box 14 of container 12 is depicted. As illustrated in FIG. 6, the hinged connector 80 is integral with the lid 20 and the back wall 18 of the box 14. The hinged connector 80 is defined by first and second longitudinal edges 86, 88 that are disposed in the back wall 18 of the box 14. The longitudinal edges 86, 88 are disposed along longitudinal edges 90, 92 of the back wall 18 of the box 14. The hinged connector 80 is connected to the lid 20 at the first hinge line 82 and connected to the back wall 18 of the box 14 at the second hinge line 84. The hinged connector 80 can have any suitable average longitudinal length 4 between the first hinge line 82 and the second hinge line 84 as measured in a direction parallel to a longitudinal axis 2 of the container 10.

The first hinge line 82 of the hinged connector 80 can be disposed any suitable longitudinal distance 6 above or below a top edge 15 of the back wall 18 of the box 14. In one or more embodiments, the first hinge line 82 is disposed at a longitudinal distance of between about 0 mm and about 15 mm from the top edge 15 of the back wall 18 the box 14.

Figure 7:
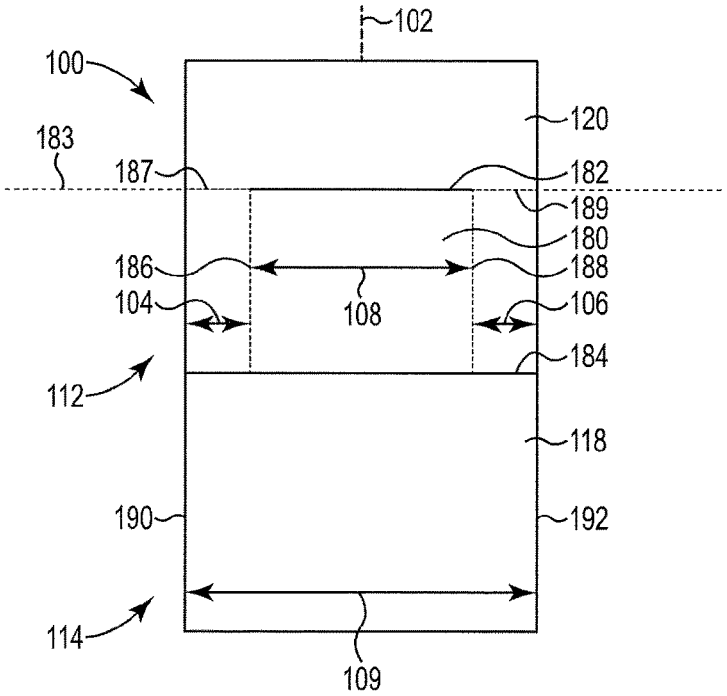
FIG. 7 is a schematic rear view of a back wall of another embodiment of a container.

Referring to FIG. 7, a schematic plan view of another embodiment of a container 100 is depicted. All of the design considerations and possibilities regarding the container 10 of FIGS. 1-6 apply equally to the container 100 of FIG. 7. As illustrated in FIG. 7, the container 100 includes a housing 112 that includes a box 114 and a lid 120. A hinged connector 180 connects the lid 120 to a back wall 118 of the box 114. The hinged connector 180 is connected to the lid 120 at a first hinge line 182 and connected to the back wall of the box 114 at a second hinge line 184. The hinged connector 180 is defined by first and second longitudinal edges 186, 188 that are disposed in the back wall 118 of the box 114. The longitudinal edges 186, 188 extend along a direction that is substantially parallel to a longitudinal axis 102 of the container 110. The hinged connector 180 is integral with the lid 120 and the back wall 118 of the box 114.

In one or more embodiments, the container 100 can include a first line of weakness 187 and a second line of weakness 189 disposed in any suitable location on the back wall 118 of the box 114. The lines of weakness 187, 189 can take any suitable shape and have any suitable dimensions. The first line of weakness 187 can be disposed in the back wall 118 in a transverse direction between a first longitudinal edge 190 of the back wall and the first longitudinal edge 186 of the hinged connector 180. The first line of weakness 187 extends along a first hinge line axis 183 that is collinear with the first hinge line 182. Further, the first line of weakness 187 intersects the first longitudinal edge 186 of the hinged connector 180. The second line of weakness 189 can be disposed in the back wall 118 in a transverse direction between a second longitudinal edge 192 of the back wall and the second longitudinal edge 188 of the hinged connector 180. The second line of weakness 189 extends along the first hinge line axis 183. Further, the second line of weakness 189 intersects the second longitudinal edge 188 of the hinged connector 180. In one or more embodiments, the first and second lines of weakness 187, 189 disposed in the back wall 118 can facilitate separating the lid 120 and the hinged connector 180 from the back wall of the box 114 such that the hinged connector can rotate about the second hinge line 184.

The first and second longitudinal edges 186, 188 of the hinged connector 180 can be disposed any suitable distance from longitudinal edges 190, 192 of the back wall 118 of the box 114. As illustrated in FIG. 7, the first longitudinal edge 186 of the hinged connector 180 is disposed at a first distance 104 from the first longitudinal edge 190 of the back wall 118. Further, the second longitudinal edge 188 of the hinged connector 180 is disposed at a second distance 106 from a second longitudinal edge 192 of the back wall 118. The first distance 104 and the second distance 106 can be equal. In one or more embodiments, the first distance 104 can be less than or greater than the second distance 106.

The longitudinal edges 186, 188 can be disposed in the back wall 114 such that they are symmetrical about the longitudinal axis 102 of the container 110. The hinged connector 180 can have a transverse width 108 as measured in a direction transverse to the longitudinal axis 102. The transverse width 108 can be any suitable percentage of a total transverse width 109 of the back wall 118 of the box 114.

Figure 8:
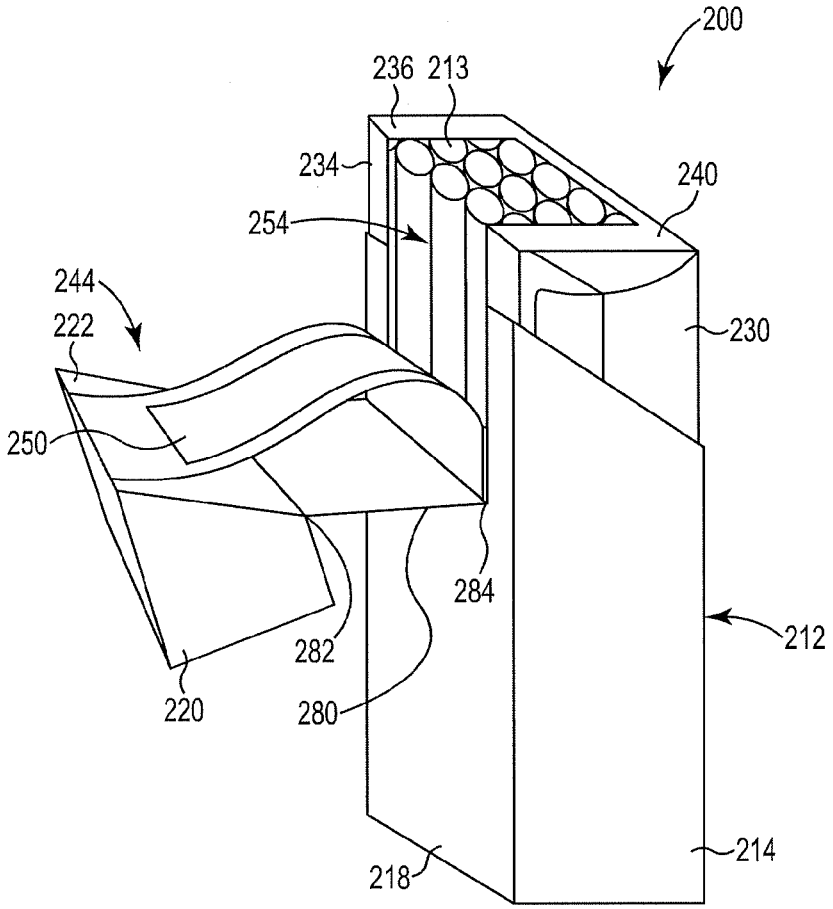
FIG. 8 is a schematic rear perspective view of another embodiment of a container.

Referring to FIG. 8, a schematic perspective view of another embodiment of a container 200 is depicted. All of the design considerations and possibilities regarding the container 10 of FIGS. 1-6 and the container 100 of FIG. 7 apply equally to the container 200 of FIG. 8. The container 200 includes a housing 212 that includes a box 214 and a lid 220. A hinged connector 280 connects the lid 220 to a back wall 218 of the box 214. The hinged connector 280 is connected to the lid 220 at a first hinge line 282 and connected to the back wall 218 of the box 214 at a second hinge line 284. The container 200 also includes an inner package 230 disposed within the housing 212. The inner package 230 includes a first layer 240 that defines a flap 244, and a second layer 250 at least partially attached to an inner surface of the first layer 240 that defines an axis opening 254 through which consumer goods 213 can be removed.

The flap 244 is attached to an inner surface 222 of the lid 220 such that the flap is separated from the inner package 230 to at least partially uncover the access opening 254 when the lid is moved from the closed position to the open position. Further, the flap 244 covers the access opening 254 when the lid 220 is in the closed position.

One difference between the container 200 of FIG. 8 and container 10 of FIGS. 1-6 is that the access opening 254 is disposed in a portion of a back wall 234 of the inner package 230 and a portion of a top wall 236 of the inner package. In one or more embodiments, the access opening 254 can also be disposed in a portion of the front wall (not shown) of the inner package 230. The access opening 254 provides access to consumer goods 213 from back and top sides of the container 200.

The invention claimed is:

1. A container for consumer goods, comprising:

a housing comprising a box and a lid, wherein the box and the lid each comprise a front wall and a back wall;

a hinged connector that connects the lid to the back wall of the box, wherein the hinged connector is connected to the lid at a first hinge line and connected to the back wall of the box at a second hinge line;

an inner package disposed within the housing and at least partially defining an interior volume for housing consumer goods, wherein the inner package comprises a front wall, a back wall, and a top wall, wherein the inner package further comprises:

a first layer that defines a flap; and a second layer at least partially attached to an inner surface of the first layer that defines an access opening through which the consumer goods can be removed, wherein the access opening is disposed in a portion of the back and top walls of the inner package;

wherein the lid is movable between a closed position and an open position, wherein the inner package is covered by the lid and the box when the lid is in the closed position and at least partially uncovered when the lid is in the open position;

wherein the flap is attached to an inner surface of the front wall of the lid such that the flap is separated from the inner package to at least partially uncover the access opening when the lid is moved from the closed position to the open position, and further wherein the flap covers the access opening when the lid is in the closed position.

2. The container of claim 1, wherein the hinged connector is integral with the lid and the back wall of the box.

3. The container of claim 2, wherein the hinged connector is defined by first and second longitudinal edges disposed in the back wall of the box.

4. The container of claim 3, wherein at least a portion of each of the first and second longitudinal edges of the hinged connector are disposed along longitudinal edges of the back wall of the box.

5. The container of claim 1, wherein the first layer of the inner package comprises a first line of weakness that defines the flap, wherein the second layer comprises a second line of weakness that defines the access opening, and further wherein the flap and a portion of the second layer attached to the flap are separated from the inner package along the first and second lines of weakness respectively to at least partially uncover the access opening when the lid is moved from the closed position to the open position.

6. The container of claim 1, wherein the first layer is an adhesive label attached to the second layer.

7. The container of claim 1, wherein the hinged connector comprises an average transverse width that is between about 40% and about 90% of an average transverse width of the back wall of the box.

8. The container of claim 1, wherein an average longitudinal length of the hinged connector between the first hinge line and the second hinge line is between about 3 mm and about 30 mm.

9. The container of claim 1, wherein at least a portion of the outer surface of the first layer of the inner package is permanently affixed to a corresponding portion of an inner surface of the front wall of the box.

10. The container of claim 1, further comprising an inner frame disposed within the box, wherein the inner frame comprises a front wall and a pair of opposed side walls.

11. The container of claim 10, wherein the inner frame is disposed between the front wall of the box and the inner package.

12. The container of claim 1, wherein the access opening is further disposed in a portion of the front wall of the inner package.

13. The container of claim 1, wherein the second layer comprises a seal region disposed along at least a portion of a perimeter of the access opening, wherein the flap is adapted to overlap the access opening into the seal region such that the flap attaches to the second layer within the seal region when the lid is in the closed position.

14. The container of claim 13, further comprising an adhesive disposed between the flap and the seal region.

15. A carton comprising the container of claim 1.

16. A container for consumer goods, comprising:

a housing comprising a box and a lid, wherein the box and the lid each comprise a front wall and a back wall;

a hinged connector that connects the lid to the back wall of the box, wherein the hinged connector is connected to the lid at a first hinge line and connected to the back wall of the box at a second hinge line, and further wherein the hinged connector is integral with the lid and the back wall of the box;

an inner package disposed within the housing and at least partially defining an interior volume for housing consumer goods, wherein the inner package comprises a front wall, a back wall, and a top wall, wherein the inner package further comprises:

a first layer that defines a flap; and a second layer at least partially attached to an inner surface of the first layer that defines an access opening through which the consumer goods can be removed, wherein the access opening is disposed in a portion of the back, top, and front walls of the inner package;

wherein the lid is movable between a closed position and an open position, wherein the inner package is covered by the lid and the box when the lid is in the closed position and at least partially uncovered when the lid is in the open position;

wherein the flap is attached to an inner surface of the front wall of the lid such that the flap is separated from the inner package to at least partially uncover the access opening when the lid is moved from the closed position to the open position, and further wherein the flap covers the access opening when the lid is in the closed position.

17. The container of claim 16, wherein the hinged connector is defined by first and second longitudinal edges disposed in the back wall of the box.

18. The container of claim 17, wherein at least a portion of each of the first and second longitudinal edges of the hinged connector are disposed along longitudinal edges of the back wall of the box.

19. The container of claim 16, wherein an average longitudinal length of the hinged connector between the first hinge line and the second hinge line is between about 3 mm and about 30 mm.

20. The container of claim 16, wherein the second layer comprises a seal region disposed along at least a portion of a perimeter of the access opening, wherein the flap is adapted to overlap the access opening into the seal region such that the flap attaches to the second layer within the seal region when the lid is in the closed position.

* * * * *